United States Patent [19]

Cane

[11] Patent Number: 4,693,540

[45] Date of Patent: Sep. 15, 1987

[54] PRESSURE REGULATING DEVICES

[75] Inventor: Michael R. Cane, Prescot, England

[73] Assignee: BICC Public Limited Company, London, England

[21] Appl. No.: 588,807

[22] Filed: Mar. 12, 1984

[30] Foreign Application Priority Data

Mar. 31, 1983 [GB] United Kingdom ..... 8308977

[51] Int. Cl.[4] ..... H01R 13/52

[52] U.S. Cl. ..... 439/198; 138/26; 166/65.1; 174/12 R; 439/271

[58] Field of Search ..... 339/117 R, 117 P, 94 R, 339/94 C, 94 M, 15, 16 R, 16 C, 28, 60 R, 60 C, 60 RC; 277/27, 3, 5; 166/65.1; 174/11 R, 12 R, 17 VA, 17 CT; 138/30, 26

[56] References Cited

U.S. PATENT DOCUMENTS

| | | | |
|---|---|---|---|
| 2,336,040 | 12/1943 | Scott et al. | 174/12 R |
| 3,059,210 | 10/1962 | Luenberger . | |
| 3,115,380 | 12/1963 | Kuehl et al. . | |
| 3,241,095 | 3/1966 | Phillips . | |
| 3,633,155 | 1/1972 | Taylor | 339/117 R |
| 3,772,636 | 11/1973 | Webb . | |
| 3,877,775 | 4/1975 | Barlow et al. | 339/117 R |
| 3,980,369 | 9/1976 | Panek | 339/28 |
| 4,373,767 | 2/1983 | Cairns | 339/94 C |
| 4,479,690 | 10/1984 | Inouye et al. | 339/117 R |
| 4,494,811 | 1/1985 | Palermo, Jr. | 339/117 R |
| 4,500,155 | 2/1985 | Chevalier | 339/117 P |
| 4,536,669 | 8/1985 | Neuroth | 174/11 R |
| 4,553,807 | 11/1985 | Cane | 339/94 R |

FOREIGN PATENT DOCUMENTS

| | | |
|---|---|---|
| 0048601 | 3/1982 | European Pat. Off. . |
| 1160105 | 7/1969 | United Kingdom . |
| 1494896 | 12/1977 | United Kingdom . |
| 2046842 | 11/1980 | United Kingdom . |
| 2103716 | 2/1983 | United Kingdom . |
| 792382 | 12/1980 | U.S.S.R. . |

*Primary Examiner*—Gil Weidenfeld
*Assistant Examiner*—Thomas M. Kline
*Attorney, Agent, or Firm*—Parkhurst & Oliff

[57] ABSTRACT

A pressure regulating device for fluidtight, fluid-filled apparatus comprises a solid body with a shallow recess in a surface enclosed by a flexible diaphragm. A narrow passage, preferably of capillary dimensions, connects the recess to the interior of the apparatus and the diaphragm is flexible enough to be deformed without injury so as to enter the recess and reduce its volume substantially and preferably practically to zero. The recess contains a volume of air which for optimum performance should be equal to the amount by which the volume can be reduced by movement of the diaphragm and also equal to the volume expansion of the fluid (or if more than one device is fitted its share of the fluid) from atmospheric conditions to mean working temperature (less the volume of any air occluded elsewhere in the apparatus). By this means, the diaphragm is substantially unstressed both under atmospheric conditions and under mean working conditions, since the gas will be compressed to a negligible volume.

8 Claims, 1 Drawing Figure

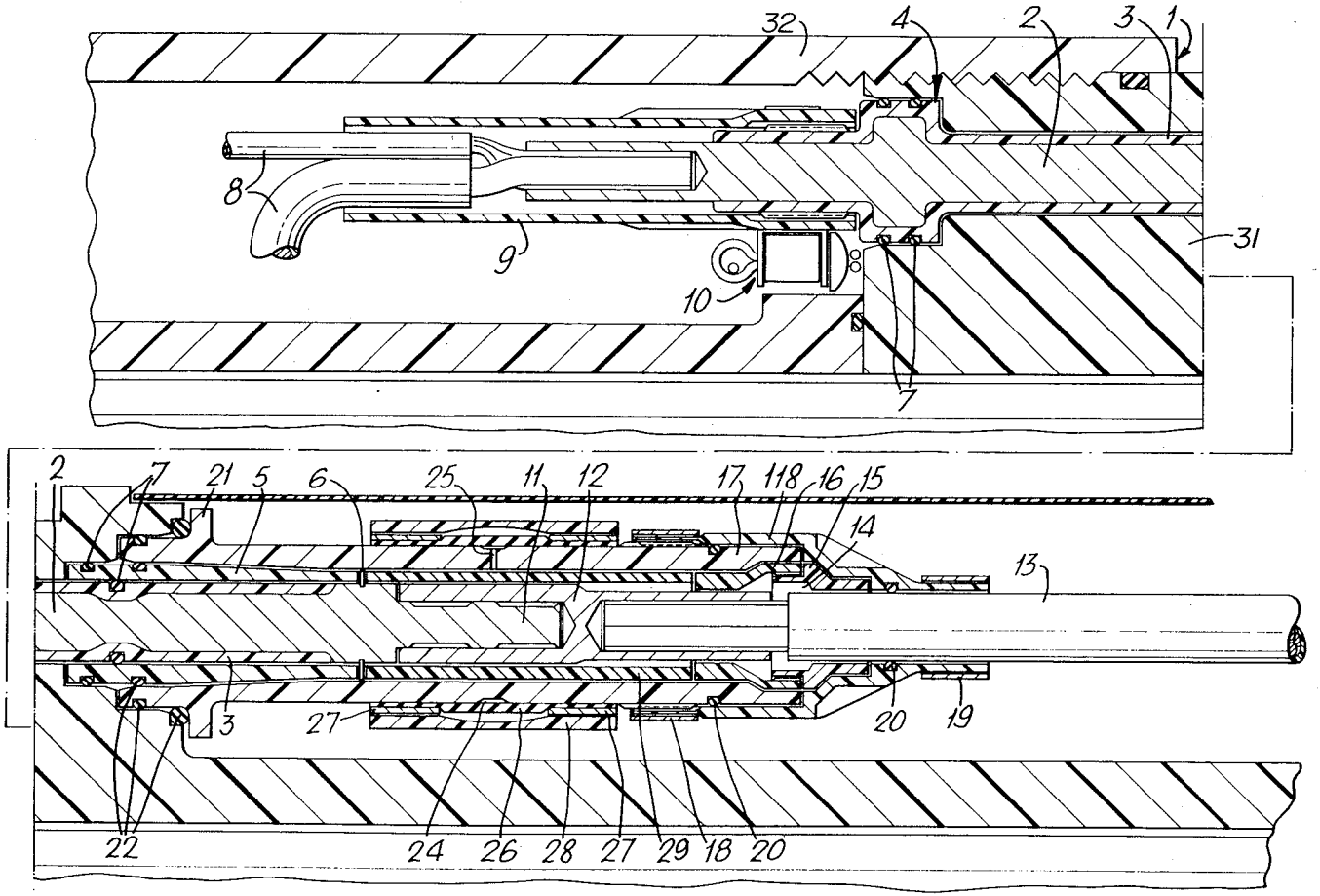
31
1
3
2
4
32
7
10
9
8
13
19
20
15
14
16
18
17
20
18
29
27
12
28
11
26
25
24
6
27
5
21
3
7
22
2

PRESSURE REGULATING DEVICES

BACKGROUND OF THE INVENTION

This invention relates to devices for regulating the pressure of a fluid within a fluidtight vessel or other fluidtight apparatus and more especially for avoiding, or at least reducing, pressure differences between the inside of the apparatus and the surrounding ambient medium. The term "fluid" as used herein means any liquids, greases, and pasty materials.

More specifically, it relates to devices for use on apparatus exposed to an ambient medium at high pressure and elevated temperature and especially (though not exclusively) when it is subject under such conditions to temperature and/or pressure cycling.

An important application of the invention is to fluid-filled electric connectors and other apparatus for subterranean use in an oil well.

Under such conditions, the integrity of sealing of the apparatus is liable to be at risk, and the most acceptable way of avoiding leakage is usually to maintain the seal(s) pressure-free or nearly so, and this entails provision for accommodating changes in the volume of fluid as temperature and/or pressure change. Sliding pistons are unsatisfactory when the ambient medium contains particles that are liable to be caught between the sliding surfaces, and simple bellows arrangements are liable to fatigue failure or the like.

SUMMARY OF THE INVENTION

In accordance with the invention, a pressure regulating device for fluidtight, fluid-filled apparatus comprises a solid body with a shallow recess in a surface thereof, a diaphragm sealed peripherally to the recess to partition it from the ambient medium, and a narrow passage connecting the recess to the interior of the apparatus, the diaphragm being so flexible that it can be deformed without injury by application of a sufficiently high ambient pressure to enter the recess and reduce its volume by a substantial amount.

The invention includes a fluidtight, fluid-filled apparatus fitted with one or more than one such device.

Preferably the narrow passage is of capillary dimensions, by which is meant dimensions so small that the particular fluid with which the apparatus is filled will not flow from the passage unless subject to a difference in pressure. A multiplicity of small holes or a plug of porous material can be used to form a passage of capillary dimensions if appropriate.

Preferably the diaphragm is flexible enough for the volume of the recess to be reduced to zero (or practically so) at the maximum ambient pressure.

The outside of the diaphragm may be exposed directly to the ambient medium or it may be protected by a body of any suitable fluid that is subject to the ambient pressure.

The diaphragm may be of any resilient material that withstands the conditions of use; in most cases fluid- and heat-resistant synthetic rubbers such as the fluorocarbon rubbers (such as that sold by E. I. Du Pont de Nemours & Co. under the trade mark VITON) and fluorosilicone rubbers are preferred. For very high temperature service a metal diaphragm may be desirable.

At least when the diaphragm is of a synthetic rubber, preferably the surface in which the recess is formed is the curved surface of a cylindrical body, such as a tubular part of the housing of the apparatus, and the diaphragm is tubular. Usually, but not necessarily, the recess will then be annular. The peripheral seal can then be ensured simply and efficiently by the use of a pair of band clamps and/or adhesive bonding of the diaphragm to the housing.

The apparatus preferably contains a small volume of air or other gas which can be compressed to limit volume changes arising from thermal expansion. When the working temperature and pressure are both high, the contained volume of gas (at atmospheric ambient) is preferably substantially equal to the volume expansion of the fluid (less the volume expansion, if significant, of the solid components containing it) on heating from atmospheric ambient to working temperature: since the volume of the gas at working pressure will be negligible, the volume of fluid plus gas will then be substantially the same under atmospheric ambient and working conditions (or at least will be substantially the same under both sets of conditions as the volume of the containing solid components) so that the diaphragm can be unstressed (i.e., subject to the same pressure inside and out) under working conditions without needing to be pre-stressed (i.e., subjected to an artificial pressure differential) during assembly.

A preferred way of regulating the volume of contained air is to locate all of it, or at least as much of it as possible, in the recess (or recesses) of the pressure regulating device (or devices) the volume of the recess (or each recess) can then be equal to the volume of air which it is to contain. Provided that the passage connecting the recess to the interior of the apparatus is of capillary dimensions, there is no difficulty in assembling the apparatus with the interior (and the passage) fluid-filled and the whole recess air-filled.

BRIEF DESCRIPTION OF THE DRAWING

The invention will be further described by way of example with reference to the accompanying drawing which is a longitudinal cross-section (divided for convenience of presentation) of an electrical connector incorporating a pressure regulating device in accordance with the invention.

DESCRIPTION OF THE PREFERRED EMBODIMENTS

The connector is for use in making one of the phase connections for the supply of power to a "downwell" pump in oil extraction. The pump has a fluid-tight casing 1, of which the relevant parts are a closure member 31 and a shell 32. Current is carried through the casing 1 by a copper terminal stem 2 insulated by a moulded sleeve 3; the insulated copper terminal stem is retained by a flange 4 bearing on the inside of closure member 31 and a moulded retaining sleeve 5 secured by a circlip 6 and bearing on the outside of the closure member. O-ring seals 7 ensure a substantially fluid-tight seal.

Inside the pump casing, cable conductors 8 are connected to the stem 2 by a conventional crimped joint which is guarded by a protective moulded sleeve 9 secured by any suitable form of clamp 10 (the clamp shown in the drawing is of the kind sold by our subsidiary BICC Vantrunk Limited under the trademark "STRAP X").

Outside the pump casing, the stem 2 is shaped to form a pin 11 which is fitted with laminated contact bands and receives a socket 12 crimped to the supply cable conductor 13. The socket 12 is sealed to the insulating covering of the cable conductor using a quantity of cold-setting insulating putty 14 (such as that sold by our subsidiary BICC Components Limited under the trademark BICASEAL) pressurized during setting to ensure good adhesion by screwing together a pair of enclosing tapered ferrules 15, 16.

The main structure of the connector is completed by a moulded insulating body 17 and a moulded end cap 118 for the socket part, which form the major components of the connector housing. These are secured together and to the conductor 13 and sealed to them using band clamps 18, 19 (for example STRAP-X clamps, Jubilee clips or Hepworth band clamps) and O-rings 20, 20. The body 17 has a non-circular flange 21 by means of which it is bolted (outside the plane of the cross-section) to the pump casing 1, further O-rings 22 ensuring a fluid-tight seal.

Spaces within the body 17 that are not occupied by the solid components have a volume of about 3600 $mm^3$ and are filled as far as possible with an electrically insulating compound such as the silicone grease sold by Dow Corning Limited as MS4 silicone compound; experience has shown that about 150 $mm^3$ of air is inevitably occluded.

In accordance with the invention, a cylindrical part of the body 17 is formed with a peripheral recess 24 which communicates with the compound filled space by passages 25 each having a diameter of 1 mm, which is of capillary dimensions, that is it is sufficiently small to inhibit the particular compound from flowing through these passages under its own hydrostatic head at all temperatures in the working range.

The recess 24 is enclosed by a tubular membrane or diaphragm 26 made of VITON fluorocarbon rubber and secured at both its peripheral edges by band clamps 27, 27 (similar to 18 and 19). The outside of the membrane 26 is protected by a separate moulded protective sleeve 28, which is not fluid-tight so that the membrane 26 is exposed on its outside to the ambient pressure; and another moulded sleeve 29, inside the body, ensures that the capillary passages 25 do not provide a short electrical breakdown path.

The various moulded parts may be made of any suitable plastics material that will withstand the thermal, mechanical and chemical stresses of the use environment; our present preference is for the polyphenylene ether-ketone sold by Imperial Chemical Industries plc under the trade mark "PEEK"; even with the best available materials, service life may be fairly short.

The enclosed volume of the recess 24 is 150 $mm^3$ when the membrane 26 is unstressed.

The connector is designed for use at a mean ambient pressure of 28 $MN/m^2$ (280 atmospheres) and a mean working temperature of 150° C. The capillary passages 25 are filled with the compound prior to assembly but the recess 24 remains air-filled when the connector is assembled under ordinary atmospheric conditions. The thermal expansion of the compound (about $7\times10^{-4}$/°C.) is large compared both to its compressibility and to the thermal expansion of the connector body, so that the volume expansion of the compound on going from atmospheric temperature and pressure to mean working pressure and temperature is about 300 $mm^3$, substantially the same as the sum of the volumes of air contained in the recess 24 and elsewhere in the connector. The air remaining in the connector is compressed to a negligible volume at working pressure, and the diaphragm enters recess 24 to temporarily reduce its volume. However, at working temperature the recess 24 becomes filled with compound, the net effect of the pressure and temperature changes therefore being to bring the diaphragm back to a substantially unstressed condition.

It will be understood that if the device is brought back after service to atmospheric pressure and temperature, or indeed to any pressure significantly below the working pressure, some compound or other fluid is likely to remain in the recess 24 and some air therefore to pass through the capillary passage 25; this is immaterial provided the air is contained within the apparatus; if on the other hand there is any possibility that the apparatus as a whole no longer contains the correct volume of air it is advisable for the device to be cleaned out and refilled before re-use, and the diaphragm may in such cases be replaced.

For some apparatus that will be used in only one orientation, the recess might be arranged to face upwardly so that the air or other gas cannot escape from it until all the fluid has been displaced.

What I claim as my invention is:

1. Apparatus for service in an ambient medium under predetermined conditions of elevated temperature and elevated pressure, said elevated pressure being many times greater than atmospheric pressure, said apparatus having a fluid-tight housing fitted with at least one pressure-regulating device for substantially avoiding pressure difference between the inside of the apparatus and the surrounding ambient medium, said pressure-regulating device comprising:

a solid body with a shallow recess in a surface thereof;

a diaphragm sealed peripherally to said recess to partition it from ambient medium; and a passage connecting said recess to the interior of said housing;

wherein said diaphragm is flexible such that on application of an elevated ambient pressure it will enter the recess and reduce its volume by a substantial amount, and further wherein said housing is filled with a major volume of fluid and a minor volume of gas, the relation of said major volume to said minor volume of being such that said fluid will expand on heating from ordinary atmospheric temperature to said predetermined condition of elevated temperature by a volume increment substantially equal to said minor volume so as to return said diaphragm to a position where it does not enter the recess;

whereby said diaphragm is substantially free of stress under both said predetermined conditions of elevated temperature and elevated pressure and under ordinary atmospheric conditions of temperature and pressure.

2. Apparatus as claimed in claim 1, wherein said substantial amount by which the volume of said recess can be reduced is substantially equal to said minor volume of gas.

3. Apparatus as claimed in claim 1, wherein said recess contains gas and said passage is of dimensions such that said fluid will not flow from said passage unless subject to a difference in pressure.

4. Apparatus as claimed in claim 1, wherein said recess is formed in the curved surface of a cylindrical body and said diaphragm is tubular.

5. An electric connector for service in an ambient medium under predetermined conditions of elevated temperature and elevated pressure, said elevated pressure being many times greater than atmospheric pressure, said connector comprising electrical connecting means and a fluid-tight housing which encloses said electrical connecting means and is fitted with at least one pressure-regulating device for substantially avoiding pressure difference between the inside of the connector and the surrounding ambient medium, said pressure-regulating device comprising:

a solid body with a shallow recess in a surface thereof;

a diaphragm sealed peripherally to said recess to partition it from ambient medium; and a passage connecting said recess to the interior of said housing;

wherein said diaphragm is flexible such that on application of an elevated ambient pressure it will enter the recess and reduce its volume by a substantial amount, and further wherein said housing is filled with a major volume of fluid and a minor volume of gas, the relation of said major volume to said minor volume being such that said fluid will expand on heating from ordinary atmospheric temperature to said predetermined condition of elevated temperature by a volume increment substantially equal to said minor volume so as to return said diaphragm to a position where it does not enter the recess;

whereby said diaphragm is substantially free of stress under both said predetermined conditions of elevated temperature and elevated pressure and under ordinary atmospheric conditions of temperature and pressure.

6. An electric connnector as claimed in claim 5, wherein said substantial amount by which the volume of said recess can be reduced is substantially equal to said minor volume of gas.

7. An electric connector as claimed in claim 5, wherein said recess contains gas and said passage is of dimensions such that said fluid will not flow from said passage unless subject to a difference in pressure.

8. An electric connector as claimed in claim 5, wherein said recess is formed in the curved surface of a cylindrical body and said diaphragm is tubular.

* * * * *